US009945625B2

(12) United States Patent
Kokinis et al.

(10) Patent No.: US 9,945,625 B2
(45) Date of Patent: Apr. 17, 2018

(54) REDUCED LENGTH BELT-FED FIREARM

(71) Applicant: MACHINEGUNARMORY, LLC, Sandy, UT (US)

(72) Inventors: John Kokinis, Sandy, UT (US); Paul Gettings, Sandy, UT (US); Daniel Fisher, Fredericksburg, TX (US)

(73) Assignee: MACHINE GUN ARMORY, L.L.C., Sandy, UT (US)

( * ) Notice: Subject to any disclaimer, the term of this patent is extended or adjusted under 35 U.S.C. 154(b) by 0 days.

(21) Appl. No.: 15/156,625

(22) Filed: May 17, 2016

(65) Prior Publication Data

US 2016/0341501 A1 Nov. 24, 2016

Related U.S. Application Data

(60) Provisional application No. 62/163,019, filed on May 18, 2015.

(51) Int. Cl.
*F41A 5/26* (2006.01)
*F41A 3/78* (2006.01)

(52) U.S. Cl.
CPC . *F41A 5/26* (2013.01); *F41A 3/78* (2013.01)

(58) Field of Classification Search
CPC ..... F41A 3/78; F41A 5/26
USPC ..... 89/193
See application file for complete search history.

(56) References Cited

U.S. PATENT DOCUMENTS 3,198,076 A * 8/1965 Stoner ..... F41A 3/26 42/75.02
7,162,822 B1 * 1/2007 Heayn ..... F41C 23/04 42/71.01
7,942,090 B1 * 5/2011 Hoffman ..... F41A 21/26 42/76.01
8,695,260 B2 * 4/2014 Kramer ..... F41A 5/18 42/69.02
2008/0307954 A1 * 12/2008 Fluhr ..... F41A 5/28 89/193

(Continued)

OTHER PUBLICATIONS

JT Elder; Harnessing the Power of Technology for trhe Warfighter USSOCOM S&T MK 48 MOD! Machinegun—Sustained Fire Upgrade; p. 31; Apr. 27, 2016.*

(Continued)

*Primary Examiner* — Joshua E Freeman
(74) *Attorney, Agent, or Firm* — Workman Nydegger

(57) ABSTRACT

A short-length, belt fed machine gun for convenient use includes: (A) a receiver having a length in the range of about 17.75 inches to about 20.3 inches, (B) a barrel assembly, and (C) a gas cycling assembly. A gas port of the barrel assembly has a width of between about 0.063 inches and 0.200 inches. The distance between a center of the gas port and the breach of the barrel is between about 7.605 inches and about 9.395 inches. The gas cycling assembly features a unique polymer kinetic energy dampener assembly located longitudinally rearward of the operating rod, which is useful in achieving a desired cycle rate of the gun (e.g., about 600 rounds per minute (RPM)) and in minimizing muzzle climb. A unique mounting bushing selectively, removably mounts to the gas cylinder in order to achieve a shortened gun with many of the advantages of conventional longer weapons.

30 Claims, 6 Drawing Sheets

(56) References Cited

U.S. PATENT DOCUMENTS

2009/0211483 A1* 8/2009 Kramer ..... F42B 5/025 102/439
2012/0144712 A1* 6/2012 Rostocil ..... F41A 9/79 42/16
2012/0144992 A1* 6/2012 Landies ..... F41A 9/33 89/128
2013/0047833 A1* 2/2013 Steimke ..... F41A 5/26 89/191.01
2014/0075815 A1* 3/2014 Jarboe ..... F41C 23/04 42/73
2014/0090283 A1* 4/2014 Gomez ..... F41A 3/26 42/25
2015/0260470 A1* 9/2015 Foster ..... F41A 3/72 89/193
2015/0267984 A1* 9/2015 Kokinis ..... F41A 3/66 42/14
2015/0323268 A1* 11/2015 Kokinis ..... F41A 11/02 89/193
2016/0003565 A1* 1/2016 Kingsbury ..... F41A 5/26 89/194
2016/0202012 A1* 7/2016 Kokinis ..... F41A 5/26 89/193
2016/0290753 A1* 10/2016 Sewell, Jr. ..... F41A 3/72

OTHER PUBLICATIONS

MGA SAW K, *Small Arms Defense Journal*, pp. 104-107, vol. 8, No. 1, published Jan. 2016 (4 pages).
Minimi Light Support Machine Gun catalog of parts and accessories; published Jan. 1998 (50 pages).
Parts diagram, Rev. A: FN90E1031, published and available, on information and belief, as least as early as Sep. 2003, 1 page.
FN Herstal Minimi Calibre 7.62×51 mm NATO Catalog of Parts and Accessories, Mar. 2008, 58 pages.
Shea, D. MGA's Semiautomatic MK46 Variant. Small Arms Review, 13(4), pp. 48-54, Chipotle Publishing, USA, published, on information and belief, at least as early as Jan. 2010.
Advertisement, Gun Envy MK 46 M249 SAW 5.56 Nato Belt Fed Semi, printed Dec. 23, 2013, 8 pages.
*Small Arms Review*, Jan. 2010, pages and advertisements, 10 pages.
J & T Distributing, Jan. 2010, *Small Arms Review*, 1 page.

* cited by examiner

REDUCED LENGTH BELT-FED FIREARM

CROSS-REFERENCE TO RELATED APPLICATIONS

This application claims priority to and the benefit of U.S. Provisional Patent Application No. 62/163,019, filed May 18, 2015, and entitled "REDUCED LENGTH BELT-FED FIREARM," which is incorporated herein in its entirety by reference.

BACKGROUND

Machine guns were developed with the goal of expending great numbers of bullets in short periods of time. While this capability has tactical advantages in many scenarios, maximum rates of fire are not always desirable for a number of reasons. For instance, ammunition is heavy and the storage and transportation thereof can be unwieldy. An individual user tasked with operating a handheld machine gun with a high ammunition cycle rate must either limit their mobility by carrying a large amount of ammunition or limit their firing behavior to conserve ammunition. Additionally, as cycle rates increase, it becomes more difficult to maintain accuracy as each cycle has a jarring effect on the weapon and the user that affects aim and accuracy.

Many conventional machine guns are, therefore, team-operated weapons that are carried, fed, and operated by more than one operator. While a machine gun offers tactical advantages, the advantages are diminished by dedicating more than one individual to operating the machine gun. For example, a primary application of a machine gun in a squad is to provide suppression of the enemy and provide a mobility advantage to the operator's cohorts. A single operator further increases the mobility of the group. Furthermore, increasing cycle rates above 600 rounds per minute provides little additional suppression capability. In fact, lower cycle rates allow skilled operators to more precisely control the quantity of rounds fired with each trigger pull.

BRIEF SUMMARY

SAWs (commonly known as Squad Automatic Weapons) are adaptable for mobile, shoulder held use, or in a semi or fully fixed state such as on a mobile tripod or mounted to a vehicle. In semi or fully fixed mounting configurations, issues with ammunition burden are diminished as compared to shoulder held use. In such individual fully mobile configurations, it is often desirable to both shorten the weapon for greater ease of use as well as reduce the cycle rate to conserve ammunition, increase reliability (i.e., mean-time-between-stoppage), and increase accuracy.

The present firearm includes a shortened receiver relative to such full sized machine guns and a variety of adjustments and changes to the following systems of such full sized machine guns in order for the gun to maintain capability with military specifications and interoperability with available military parts.

At least some embodiments described herein include a belt-fed machine gun including a receiver, a barrel assembly, and a gas cycling assembly. Generally, the receiver at least partially supports both the barrel assembly and the gas cycling assembly and generally provides the structure to the firearm. The barrel includes a central bore, a gas port, and a chamber. The gas cycling assembly includes a gas cylinder, operating rod, and operating group carrier. As pressurized gas is introduced with the central bore of the barrel, it is captured and diverted to the gas cycling assembly through the gas port. As the pressurized gas enters the gas cycling assembly, the operating rod is forced rearward resulting in a cycling in of a new round of ammunition.

The cycle rate in some embodiments is determined by a multi-variable relationship including at least the gas port size, the distance between the gas port and the breach line at the rear of the chamber, the distance between the gas port and the forward end of the barrel, the chamber pressure of the particular type of ammunition fired, and the volume of the central bore. There are nearly endless multi-variable trade-offs present in any attempt to shorten the distance between a gas port and a breach line while maintaining preferred cycle rates and mean time before stoppage characteristics.

Included herein are detailed specifications relating to resolving various relationships to reach a preferred cycle rate while, at the same time, shortening the overall length and weight of the firearm for altered operational objectives.

For example, as compared to one common iteration of an M249 belt-fed machine gun, one embodiment of the present firearm is shortened approximately three inches. This shortening has been achieved through various novel improvements including relocation of the gas port, changing the gas port size, shortening the gas cylinder, and shortening the receiver, among other changes.

Further improvements are disclosed including a kinetic energy dampening assembly that can be modified by a user to further tune an embodiment of the shortened belt-fed machine gun to operate at a range of ammunition cycle rates while maintaining suitable operational tolerances. Some embodiments including the dampener assembly also allow for removal of the rear butt-stock assembly without altering the firing characteristics of the firearm. The use and assembly of the kinetic energy dampening assembly of the present invention is useful in achieving a desired cycle rate of the gun (e.g., about 600 RPM) and in minimizing muzzle climb during shooting.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
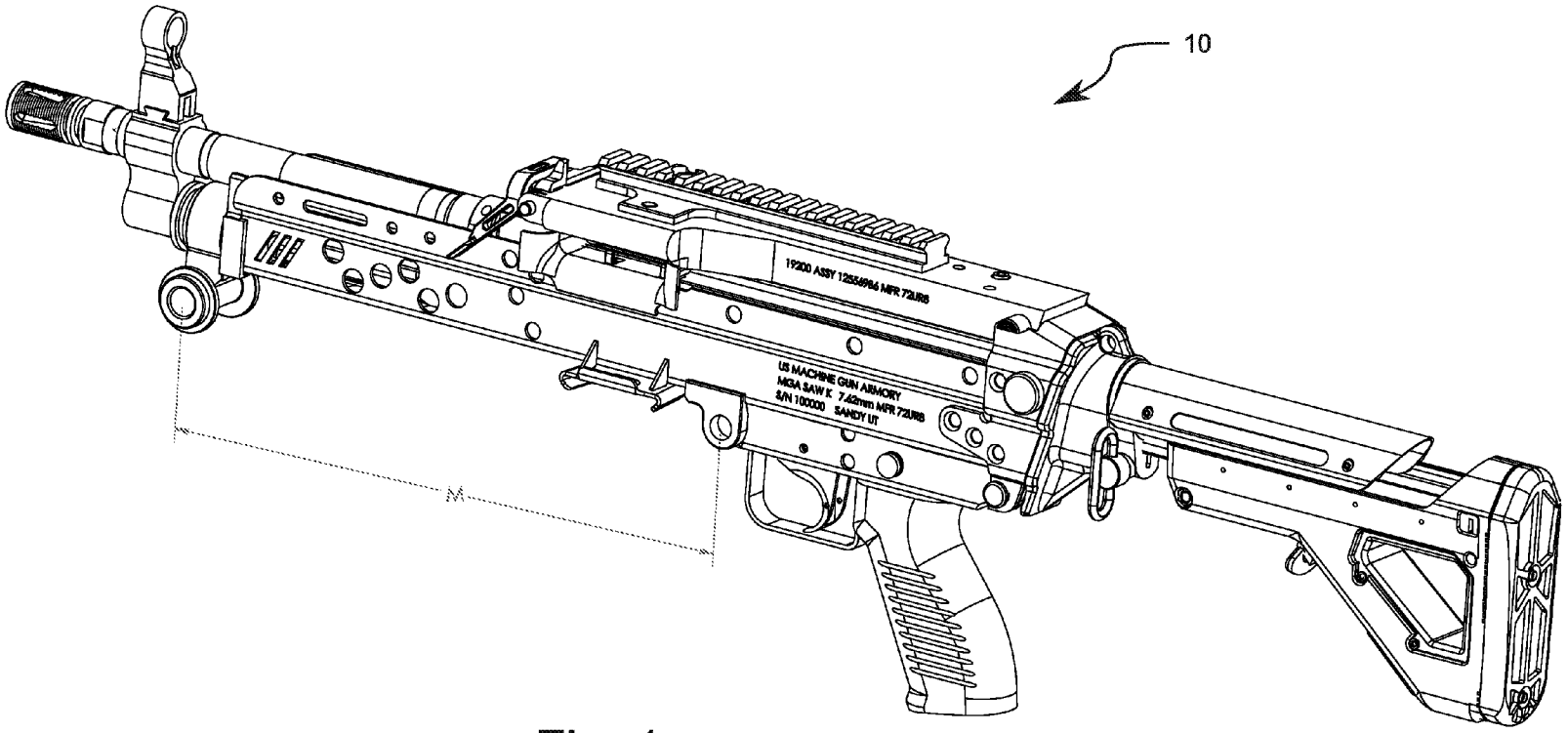
FIG. 1 illustrates an embodiment of a shortened belt-fed machine gun.

The present disclosure includes numerous improvements over the prior art that, in combination, produce a shortened belt-fed firearm that both maintains compatibility with many existing M249 platform components, while also providing novel utility through shortening the overall length of the firearm and tuning the cycling characteristics to better match the demands of a user interested in a shortened SAW.

Generally, the present disclosure includes a belt-fed machine gun including a receiver, a barrel assembly, and a gas cycling assembly. The receiver partially supports both the barrel assembly and the gas cycling assembly and generally provides the structure to the firearm as a whole.

The barrel assembly includes an elongated cylindrical barrel with a forward end and a rear end and has a central bore that extends longitudinally between the two ends. The rear end portion of the barrel includes a chamber defined by a broadening of the central bore to accommodate a compatible ammunition type. It is understood in the art that the plane located at the rear most portion of the chamber defines the breach of the firearm. The barrel also has a gas port disposed in the side of the central bore that provides an avenue for fluid communication between the central bore and the gas cycling assembly.

Depending on the embodiment, in a firearm having a receiver length between about 17.75 inches and about 20.3 inches (e.g., about 18.3 inches), the width of the gas port will be between about 0.063 inches and about 0.092 inches (e.g., between about 0.088 inches and about 0.090 inches) and the distance between the center of the gas port and the breach will be between about 7.605 inches and about 9.395 inches (e.g, about 8.355 inches and about 8.395 inches).

The barrel assembly also includes a gauge line located along the shoulder that leads into the main portion of the ammunition chamber. The location of the gauge line is specified by the type of ammunition to be fired. It should be appreciated that caliber of ammunition alone is insufficient to determine the location of the gauge line as differing casing designs for analogous caliber ammunition may require relocation of the gauge line. Depending on the embodiment, the distance between the center of the gas port and the gauge line may be between about 6.887 inches and about 6.927 inches.

In some embodiments, the barrel assembly will also include a barrel extension with a front end attached to the elongated barrel, and a rear end adapted for connecting to a receiver. In some of such embodiments, the distance between the center of the gas port and the rear end of the barrel extension is between about 8.50 inches and about 9.75 inches. In some embodiments discussed in this application, the distance between the center of the gas port and the rear end of the barrel extension will be between about 9.0 inches and about 9.300 inches, such as between about 9.121 inches and about 9.161 inches, for example.

The belt fed machine gun further includes a gas cycling assembly that includes a gas cylinder and an operating rod. The operating rod is at least partially contained within the gas cylinder and configured to move longitudinally within the gas cylinder when pressurized gas is introduced into the gas cylinder through the gas port of the central bore. As pressurized gas enters the gas cylinder, the operating rod is forced rearward within the gas cylinder. At a certain point, the operating rod reaches the extent of its rearward travel and strikes a polymer kinetic energy dampener that dissipates an amount of kinetic energy from the operating rod.

Turning now to the figures, FIG. 1 is an illustration of a shortened belt-fed machine gun 10. The machine gun 10 shares compatibility with a range of M249 parts and accessories. This allows the shortened machine gun 10 of this application to be operated and repaired in many cases using readily available and standardized parts. It also ensures the firearm meets Military Spec standards for M249 platform firearms.

Figure 2:
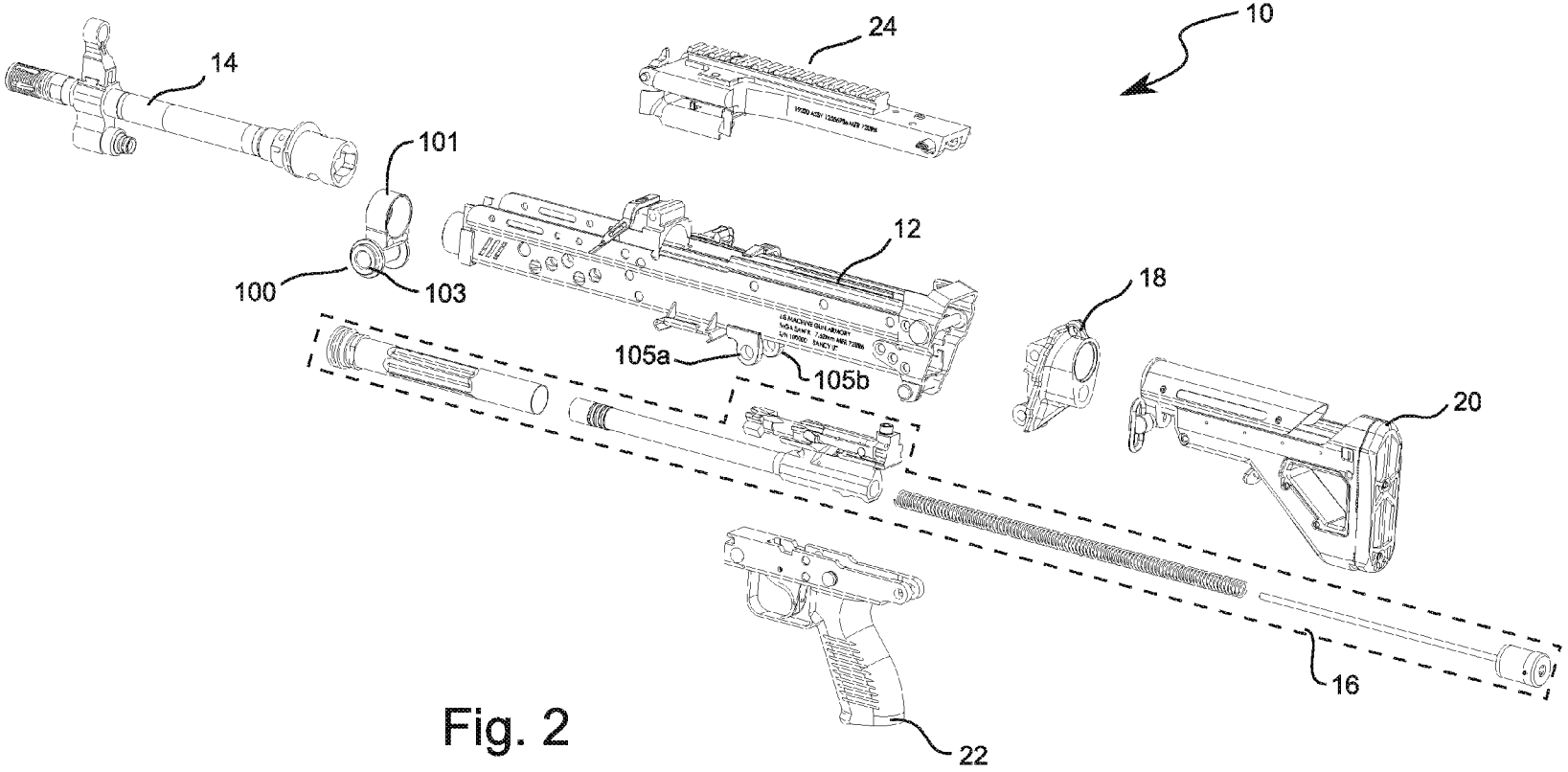
FIG. 2 illustrates an exploded view of various sub components of the shortened belt-fed machine gun of FIG. 1.

FIG. 2 shows an exploded illustration of various components and subassemblies of the shortened machine gun. Machine gun 10 includes a receiver 12, a barrel assembly 14 (comprising barrel 40), a gas cycling assembly 16, a combination receiver termination plate and butt-stock adapter 18, a removable butt-stock 20, a trigger group 22, a top cover 24, and a mounting bushing 100 for mounting to a support tripod or other support stand.

Mounting bushing 100 comprises a hollow, circular sleeve 101 having a hollow tubular bracket 103 connected transversely thereto, wherein the sleeve 101 is selectively, removably mounted on a circular tip of the gas cylinder 70, as illustrated in FIGS. 1-2. The hollow tubular bracket 103 below the sleeve 101 of bushing 100 selectively receives front connecting members of a support tripod or other support stand therein, the back connecting members of the support tripod connecting to the trigger group support brackets 105*a*, 105*b* mounted on receiver 12. In one embodiment, the distance "M" (see FIG. 1) between the center of the hollow tubular bracket 103 of bushing 100 and the center of the holes of the opposing brackets 105*a-b* is about 11.106 inches in order to have a size compatible to mount to standard military support tripod or other similar support stands.

To maintain such M249 tripod support platform compatibility, in one embodiment, some dimensions of the receiver 12, top cover 24, trigger package 22, and much of the gas cycling assembly 16 are unchanged over stock M249 machine guns. Additionally, while a standard M249 buttsock adapter can be used with the shortened machine gun disclosed herein, other butt-stocks may be used. For example, foldable butt-stocks, or butt-stocks from other types of firearms may be made compatible simply by changing the combination receiver termination plate and butt-stock adapter. It should be appreciated that the improvements present in this disclosure also allow an M249 compatible machine gun to be used entirely without a butt-stock and without altering the firing characteristics of the shortened machine gun.

FIG. 2 illustrates a novel receiver shortening approach embodied by a modification made to the receiver relative to common iterations of M249 compatible belt-fed machine guns. Commonly, a mounting bushing for adapting a belt-fed machine gun for use on a fixed stand like a tripod or truck mount is permanently attached near the forward end of the receiver. The location of this mounting bushing, and desirability of maintaining this mounting capability, has heretofore limited the degree to which one could shorten the weapon by shortening the receiver.

In the embodiment of FIG. 2, however, the receiver 12 has been shortened by, in effect, cutting the receiver off behind the location of the older style receiver mounted bushing. A new and novel, detachably installed mounting bushing 100, as described above, is then provided and configured to selectively, removably mount to the gas cylinder 70 instead of being fixed to the receiver 12. This novel approach has effectively shortened one embodiment of the receiver 12 of the present invention by about 3.025 inches. For example, in one embodiment, the length of the receiver 12 of the present invention is between about 17.75 inches and about 20.3 inches, such as about 18.3 inches, although various sizes are available under the present invention. This shortening has simultaneously increased the capability of the firearm by allowing the mounting bushing 100 to be removed if weight is a concern, replaced if wear is a concern, or changed if an alternative mounting configuration is needed. The placement and use of bushing 100 selectively, removably mounted on the gas cylinder 70 enables machine gun 10 to operate with many of the advantages of previous guns, but in a shortened embodiment, providing decreased weight and increased mobility.

Figure 3:
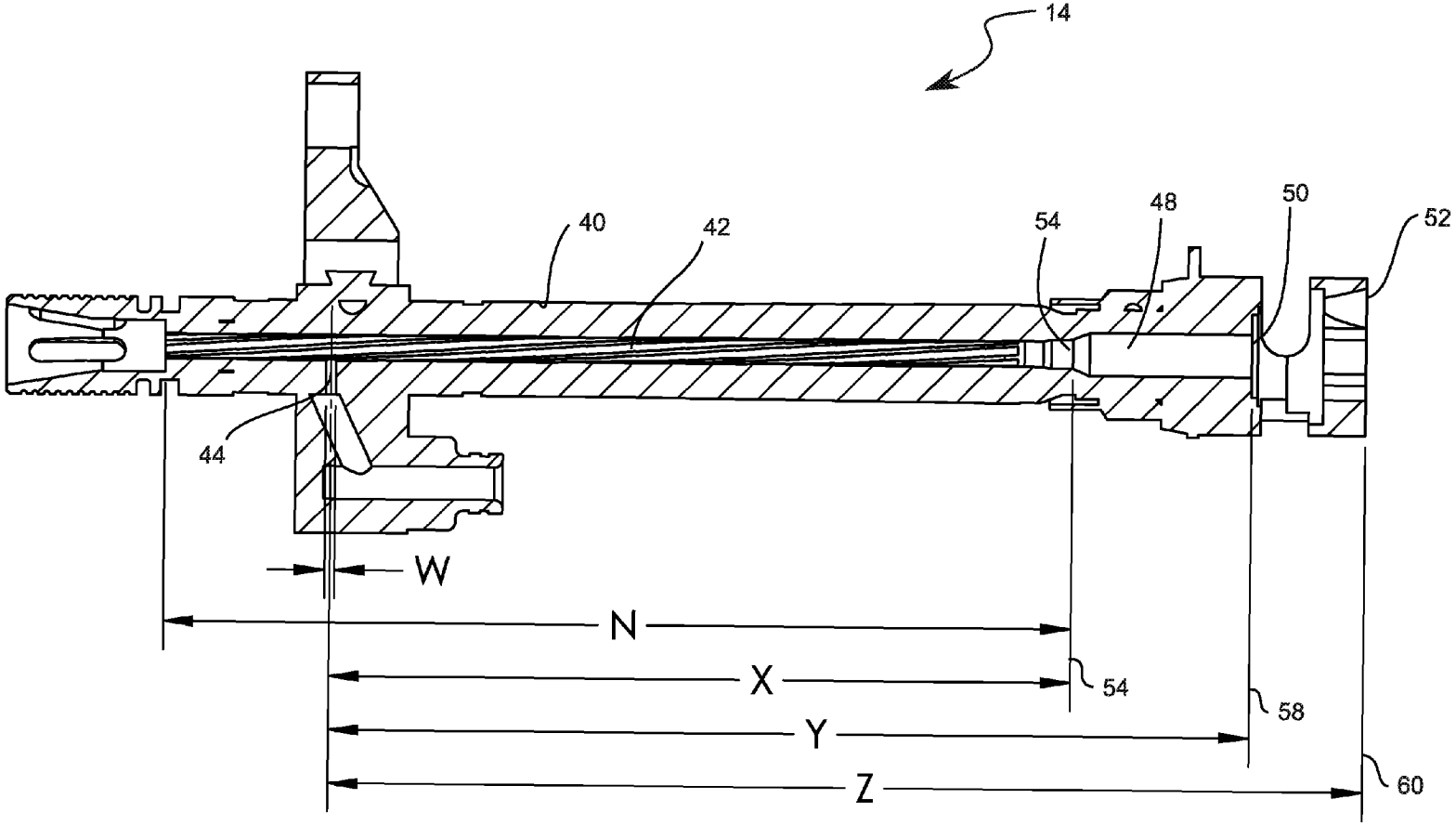
FIG. 3 illustrates a cross section of the barrel assembly of the shortened belt-fed machine gun of FIG. 1 with particular dimensions called out.

Turning to FIG. 3, a cross-section of the barrel assembly 14 is shown. The illustration includes an elongated barrel 40 with a central bore 42 extending longitudinally along the entire length of the barrel. A gas port 44 is disposed within, and extending entirely through, a side of the barrel 40. The gas port 44 fluidly communicates with the gas cycling assembly 16. The barrel assembly also includes a chamber 48 defined at its forward end by gauge line 54 and by its rear end by breach line 50. The barrel also includes a barrel extension 52.

The cycle rate of the embodied machine gun is determined by a multi-variable relationship including at least the gas port size, the distance between the gas port and the breach line, the distance between the gas port and the forward end of the barrel, the chamber pressure of the particular type of ammunition fired, and the volume of the central bore. While moving a gas port closer to a breach line of the machine gun sometimes requires increasing the gas port width, the shortened distance also results in higher chamber pressures at the now closer gas port, tending to warrant a smaller gas port size. Other multi variable trade-offs are present in any attempt to relocate a gas port.

Further, it should be appreciated that there are a range of appropriate sizes for a gas port at any of a range of distances between a gas port and a breach line. While continually making a gas port smaller will generally decrease cycle rates to an eventual stop and increasing gas port size will generally increase cycle rates to a point of melting or component failure, a range does exist wherein a gas port size may be chosen to cause the weapon to exhibit particular characteristics or to accomplish particular operating objectives.

In one embodiment illustrated by FIG. 3, in which receiver 12 is between about 17.75 inches to about 20.3 inches (e.g., about 18.3 inches) in length, the gas port 44 is between about 0.063 inches and about 0.200 inches in width, the distance "Y" between the center of the gas port and the breach line is between about 8.355 inches and about 8.395 inches, the distance "X" between the gas port and the gauge line 54 is between about 6.887 inches and about 6.927 inches, and the distance "Z" between the gas port and the end of the barrel extension 52 is between about 9.121 inches and about 9.161 inches. Within these ranges, in one embodiment, the overall shortening of the firearm is maximized while maintaining reliability and remaining within operational cycle rate requirements.

As a specific example, in one embodiment of the present invention, receiver 12 has a length of about 18.3 inches, distance Y is about 8.375 inches, the gas port width is about 0.089 inches and the distance "M" (see FIG. 1) from the center of tubular bracket 103 to the center of the holes of brackets 105*a-b* is about 11.106 inches.

In another embodiment of the present invention illustrated in FIG. 3, the gas port 44 is between about 0.063 inches and about 0.200 inches in width, the distance "Y" between the center of the gas port and the breach line is between about 7.605 inches and about 9.395 inches, the distance "X" between the gas port and the gauge line 54 is between about 6.137 inches and about 7.927 inches, and the distance "Z" between the gas port and the end of the barrel extension 52 is between about 8.371 inches and about 10.161 inches. Such ranges may suggest adjustments to the specific sizes of the receiver, gas cycling assembly, and/or bushing 100 in light of the disclosure herein. For example, in one such embodiment, the length of the receiver 12 is between about 17.75 inches and about 20.3 inches.

In yet another embodiment of the present invention illustrated in FIG. 3, the gas port 44 width is between about 0.063 inches and about 0.200 inches, the distance "Y" between the center of the gas port and the breach line is between about 8.105 inches and about 8.645 inches, the distance "X" between the gas port and the gauge line 54 is between about 6.627 inches and about 7.177 inches, and the distance "Z" between the gas port and the end of the barrel extension 52 is between about 8.871 inches and about 9.411 inches. Such ranges may also suggest adjustments to the specific sizes of the receiver, gas cycling assembly, and/or bushing 100 in light of the disclosure herein. For example, in one such embodiment, the length of the receiver 12 is between about 18.05 inches and about 19 inches.

In some embodiments, the distance "Y" between a center of the gas port and the breach is between about 8.365 inches and about 8.385 inches, e.g., about 8.375 inches.

In other embodiments, the gas port 44 width is between about 0.080 inches to about 0.140 inches. In other embodiments, the gas port 44 width is between about 0.083 inches to about 0.137 inches. In other embodiments, the gas port 44 width is between about 0.085 inches to about 0.135 inches.

In other embodiments, the gas port 44 width is between about 0.085 inches to about 0.092 inches. In other embodiments, the gas port 44 width is between about 0.087 inches to about 0.081 inches. In other embodiments, the gas port 44 width is between about 0.088 inches to about 0.090 inches.

In other embodiments, the gas port 44 width is between about 0.063 inches to about 0.092 inches. In other embodiments, the gas port 44 width is between about 0.075 inches to about 0.091 inches. In other embodiments, the gas port 44 width is between about 0.080 inches to about 0.090 inches.

In other embodiments, the entire barrel assembly 12 may be adapted for compatibility with different calibers and/or configurations of ammunition. For example, a barrel assembly 12 may be configured to support 5.56×45 mm ammunition cartridges. In such a configuration, the distance between the center of the gas port and the breach line would remain unchanged. However, the distance between the center line of the gas port and the gauge line may be different than with a smaller or larger caliber ammunition.

Similarly, a barrel assembly 12 may be configured to support 7.62×51 mm ammunition cartridges as well as 6.8 mm SPC ammunition cartridges. In both of these additional ammunition configurations, the distance between the center of the gas port and the breach line would remain the same but the distance from the center of the gas port to the gauge line would vary with the caliber and casing configuration It should be appreciated that the present disclosure is not limited to any particular embodiments based on specific caliber types as the distance from the center of the gas port to the breach line will remain within the stated ranges.

In some embodiments, the total length of the barrel may be altered in accordance with user or operational objectives. As illustrated by FIG. 3, the total length of the barrel is defined as the distance "N" between the end of the muzzle and the breach line at the rear of the chamber. As is further indicated in FIG. 3, in some embodiments the distance "Y" remains the same even as calibers and overall barrel lengths are changed. Thus, in some embodiments, as barrels increase in length, the distance "N" from the gas port to the end of the muzzle increases while the distance "Y" from the gas port to the breach does not.

The following table illustrates the relationship in some embodiments between ammunition type, overall barrel length "N", and gas port size employing a receiver 12 having a length of about 18.3 inches:

| Caliber | Barrel Length "N" | Gas Port Diameter |
|---|---|---|
| 5.56 × 45 mm | 10 inch | about 0.135 inches |
| 5.56 × 45 mm | 14 inch | about 0.089 inches |
| 6.8 mm SPC | 10 inch | about 0.125 inches |
| 6.8 mm SPC | 14 inch | about 0.100 inches |
| 7.62 × 51 mm | 14 inch | about 0.125 inches |
| 7.62 × 51 mm | 17 inch | about 0.125 inches |

However, other embodiments of highly useful shortened machine guns are available in connection with the present invention.

Figure 4:
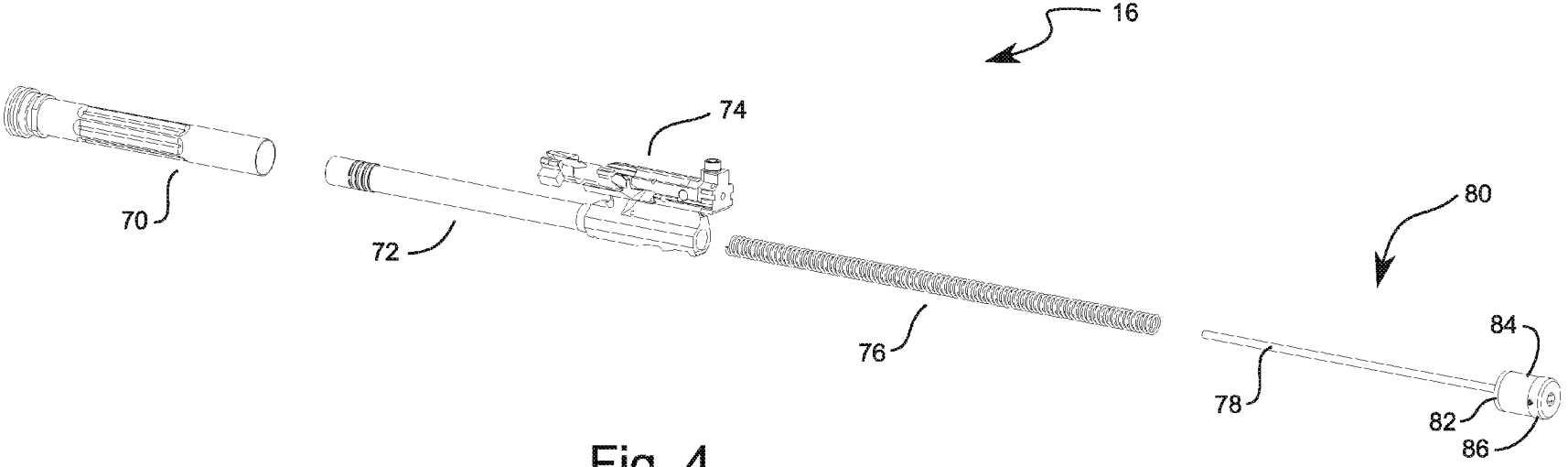
FIG. 4 illustrates an exploded view of the gas cycling assembly of the shortened belt-fed machine gun of FIG. 1.
Figure 4A:
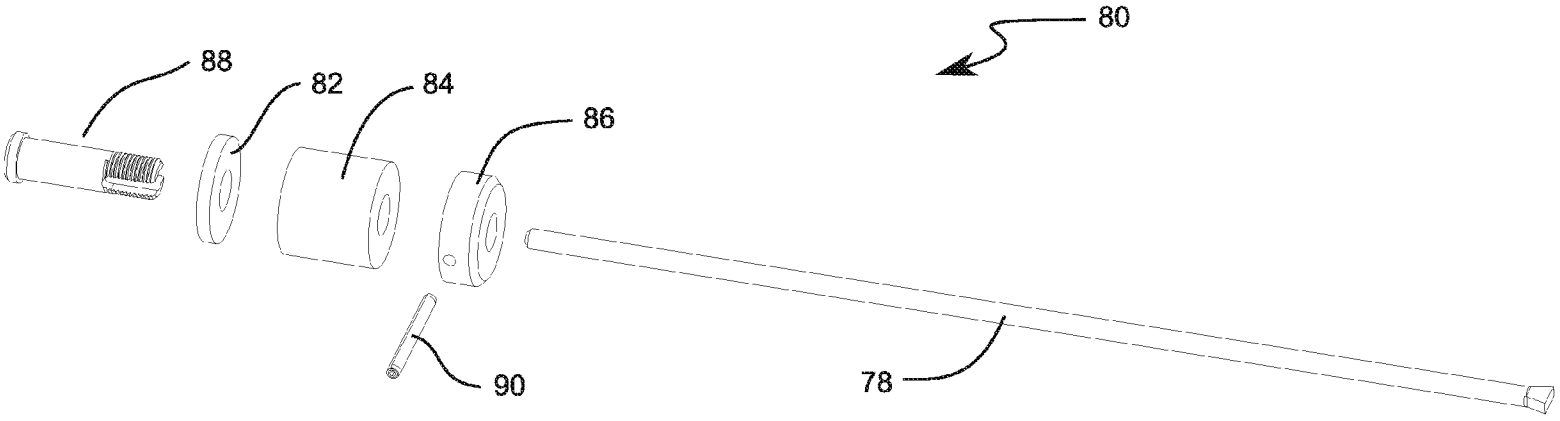
FIG. 4*a* illustrates an exploded view of the polymer dampener assembly and return rod of the shortened belt-fed machine gun of FIG. 1

Turning to FIGS. 4 and 4A, an exploded view of the gas cycling assembly 16 is shown. The assembly includes a gas cylinder 70, operating rod 72, operating group carrier 74, recoil spring 76, and buffer sub-assembly 80 which is comprised of: return rod 78, polymer buffer disc 82, polymer buffer disc 84, and buffer assembly retainer disc 86.

When machine gun 10 is fully assembled, gas cylinder 70 is partially housed within receiver 12. Operating rod 72 is then configured to travel longitudinally within cylinder 70. Operating group carrier 74 is attached to operating rod 72 and remains outside of gas cylinder 70. Recoil spring 76 is partially contained within operating rod 72 and return rod 78 is contained therein. Buffer sub-assembly 80, including return rod 78 and the other components shown in FIG. 4A, creates a stopping point for the rearward travel of the operating rod 72 and operating group carrier 74 sub-assembly.

The use and assembly of buffer sub-assembly 80 of the present invention is useful in achieving a desired cycle rate of the gun (e.g., about 600 RPM) and in minimizing muzzle climb during shooting.

During operation, pressurized gas created when a cartridge is fired is captured through the gas port disposed in the side of the barrel and diverted into gas cylinder 70. The pressure causes operating rod 72 and operating group carrier 74 to be forced rearward. As it travels rearward, recoil spring 76 is compressed against the buffer assembly 80 such that at the end of the cycle, the recoil spring decompresses pushing the operating rod 72 forward to begin the cycle again.

The kinetic energy contained within the rearward traveling operating rod 72 needs to be dissipated such that the energy isn't transferred to the user though the butt-stock. To accomplish this kinetic energy dissipation, return rod 72 strikes buffer assembly 80 at the end of the rearward stroke. As shown in FIG. 4, buffer assembly 80 includes polymer disc 82, which is contacted by recoil spring 76, and polymer disc 84 as well as a buffer assembly retaining disc 86.

In one embodiment, polymer disc 82 is an about 0.125 inches thick, solvent-resistant polymer with a durometer rating of between 55A and 65A. This relatively rigid polymer disc 82 provides some kinetic energy dissipation but also serves as a wear buffer disc to protect elastomeric polymer disc 84, which is sandwiched between disc 82 and disc 86 during cycling of the gun 10. In one such embodiment, polymer disc 84 is an about 0.875 inches thick, high-temperature silicone rubber polymer/elastomer with a durometer rating of between 5A and 25A. Because of the lower durometer rating and significantly thicker material, polymer disc 84 provides the majority of the kinetic energy dissipation provided by buffer assembly 80.

In the embodiment shown in FIGS. 4 and 4A, the ratio between the thickness of the contacted polymer disc 82 and the sandwiched polymer disc 84 is about 1 to 7. This 1:7 ratio provides desirable dampening characteristics while simultaneously ensuring adequate cycle counts before the buffer needs to be replaced. In yet another embodiment, the ratio between the thickness of polymer disc 82 and polymer disc 84 is between about 1 to 3 and about 1 to 15. Buffer assembly 80 is thus highly advantageous.

Thus, in one embodiment of the present invention, in the firearm 10, the dampener comprises a first portion and a second portion, wherein the first portion has a first thickness, and the second portion has a second thickness, the first portion comprising a first polymer disc 82, and the second portion comprising one or more additional polymer discs 84, and wherein the ratio between the first thickness and the second thickness is about 1 to 7.

For example, in one embodiment, the first portion has a thickness of about 0.125 inches and the second portion has a thickness of about 0.875 inches, and the first portion has a durometer rating of at least about 50A to about 75A and the second portion has a durometer rating of between about 5A and about 30A.

In another embodiment, the buffer assembly 80 comprises a first portion and a second portion, wherein the first portion has a first thickness, and the second portion has a second thickness, the first portion comprising a first polymer disc 82, and the second portion comprising one or more additional polymer discs 84, and wherein the ratio between the first thickness and the second thickness is between about 1 to 3 and about 1 to 15.

Thus, in one embodiment, the buffer assembly 80 of the present invention comprises a first portion comprised of a wear disc 82 adjacent a second portion comprised of one or more elastomeric polymer discs (e.g., disc 84), wherein the thickness ratio between the first portion and the second portion is between about 1 to 3 and about 1 to 15, e.g., about 1 to 7.

It should be appreciated that differing combinations of polymer discs with varying durometers and thicknesses may be implemented without departing from the essential characteristics of the present disclosure. For example, an embodiment may include a front, wearing buffer disc of about 0.125-inch thickness, a second (sandwiched) buffer disc of about 0.500-inch thickness, and a third (sandwiched) buffer disc of about 0.375-inch thickness. In this embodiment, three polymer discs are used but the about 1 to 7 thickness ratio between the front, wearing disc, and the two rear discs is maintained. Additionally, some embodiments may create adequate buffering with a buffer assembly that is greater than or less than 1 inch in total depth. For instance, a front wearing buffer may be about 0.250-inches thick while a single disc or set of rear buffer discs combine to be about 1.75 inches thick. As discussed in conjunction with FIG. 4*a*, the 1 to 7 thickness ratio between the front wearing buffer disc and the one or more rear buffer discs is co-dependent on the relative durometer ratings of those respective discs. Thus, selecting a higher durometer rating for the front wear disc may result in a thinner disc profile. The rear buffer discs may then need to increase in thickness to overcome the diminished kinetic energy dampening characteristics of the higher durometer wear disc. In such an embodiment, the result may alter the approximately 1 to 7 ratio illustrated by the embodiment in FIG. 4.

It should be appreciated that the durometer ratings of the various discs within buffer assembly 80 may be selected by a user in order to tune the machine gun 10 to different cycle rates without altering any other aspect of the gun. For example, a user seeking to lower the cycle rate of the embodied shortened machine gun may select a front disc 82 with a durometer rating suitable for wear protection, and a rear buffer disc 84 with a durometer rating on the lower end of the about 5A to about 25A range disclosed herein. The lower durometer rating on the rear buffer disc will generally dissipate more kinetic energy from the rearward traveling operating rod and slow the rate of fire of the system as a whole. Conversely, a user desiring a higher rate of fire may select a rear buffer disc 84 with a durometer nearer the upper end of the about 5A to about 25A range.

It should be appreciated that various combinations of rear buffer durometers may be implemented to balance the performance characteristics desired by the user with reliability and wear requirements and other desired parameters. For example, in embodiments of machine gun 10 conforming with gas port sizes and gas port to breach distances disclosed herein, buffer discs could be selected to allow a cycle rate of about 600 rounds per minute (RPM) to be achieved while maintaining acceptable mean rounds before stoppage thresholds. In one embodiment, the approximate 600 RPM cycle rate achieved by firearm 10 enables accurate control of the firearm and desirable operational objectives such as ammunition conservation, while still enabling adequate suppressive fire. Additionally, by choosing durometer ratings near the higher end of the disclosed range, cycle rates of about 700 RPM, about 800 RPM, about 900 RPM, or about 1,000 RPM may be achieved.

Figure 5:
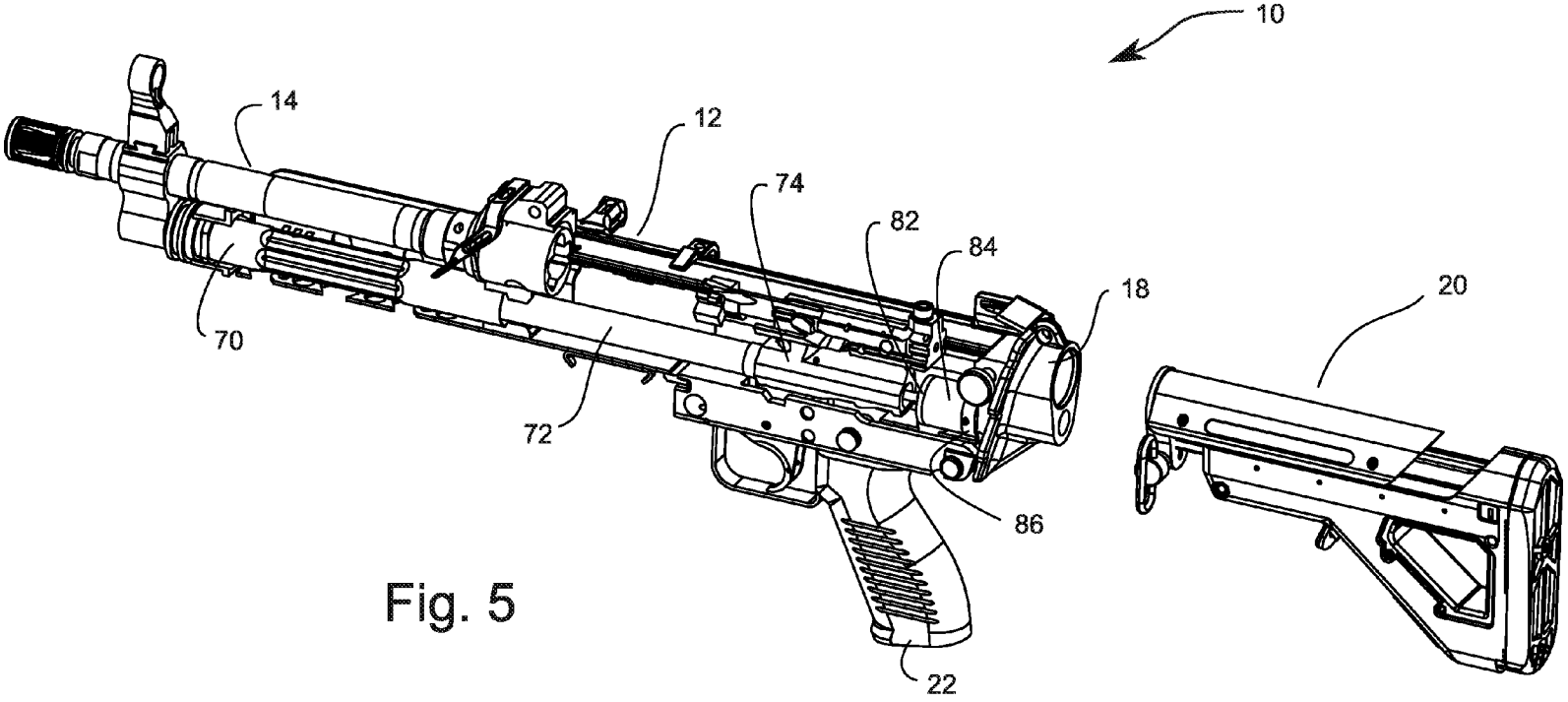
FIG. 5 is a cutaway view of the gun of FIG. 1, illustrating particular internal components of the shortened belt-fed machine gun of FIG. 1 through a cut-away of a portion of the exterior wall of the receiver (mounting bushing 100 not shown).

Turning now to FIG. 5, the machine gun 10 is shown with a portion of receiver 12 removed so that some of the internal components can be illustrated in their assembled configuration. Particularly, barrel assembly 14, gas cycling assembly 16, combination receiver termination plate and butt-stock adapter 18, and removable butt-stock 20 are shown. Particularly, in this embodiment, buffer retaining disc 86 is illustrated and shown installed in direct contact with rear plate adapter 18. As such, the buffer assembly 80 and gas cycling assembly 16 is entirely confined to portions of the machine gun 10 forward of the rear plate adapter 18. This configuration allows butt-stock 20 to be foldable, removable, or even entirely omitted without altering the essential operation of the gun.

In FIG. 4*a*, an exploded of polymer bushing assembly 80, including return rod 78, polymer buffer disc 82, polymer buffer disc 84, buffer assembly retainer disc 86, retainer pin 88, and buffer head pin 90. As illustrated in the figure, the exploded discs 82, 84, 86 slide over hollow retainer pin 88 in sequence and hollow retainer pin 88 slides onto the rear portion of return rod 78, as illustrated in FIG. 5. As further illustrated in FIG. 4A, retainer pin 88 is held in place within disc 86 by inserting buffer head pin 90 through one or more side holes in assembly retainer disc 86 (e.g., through side holes on opposing sides of disc 86) and contacting retainer pin 88. In that manner, polymer discs 82 and 84 are held in sequence at the rearward end of return rod 78. In another embodiment, buffer head pin 90 extends through the side hole(s) in assembly retainer disc 86, contacting return rod 78 and/or retainer pin 88. It should be appreciated that alternative methods of securing the polymer discs to the return rod 78 could be employed in some embodiments and that some embodiments may not include a return rod.

Polymer disc 82 functions as both a wear reducing disc as well as a force distributing disc. Disc 82 may be made of a polymer, nylon, DURON®, or even metal or alloy material, or any other suitable material. The primary requirement for polymer disc 82 is that it has a relatively higher durometer rating than polymer disc 84 such that it will not deform to as great of a degree upon impact with assembly 74 as will disc 84. In some embodiments, polymer disc 82 is comprised of a solvent-resistant polymer with a durometer rating of between about 55A and about 65A.

Generally, the relative thickness of disc 82 to disc 84 will vary dependent on the durometer rating of disc 82. If a material with a high durometer rating is selected for disc 82, such as a metal alloy, the thickness of the disc may be reduced while providing similar characteristics to a thicker disc with a lower durometer rating. However, disc 84 will generally then increase in thickness to compensate for the lower kinetic energy dissipation of the higher durometer disc 82. Consequently, the thickness and durometer rating of disc 82 should be taken into account when selecting a thickness and durometer rating for disc 84 in order to maintain predictable dampening characteristics.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value, for example.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, or within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

Although the subject matter has been described in language specific to structural features and/or methodological acts, it is to be understood that the subject matter defined in the appended claims is not necessarily limited to the described features or acts described above, or the order of the acts described above. Rather, the described features and acts are disclosed as example forms of implementing the claims.

The inventions discussed herein are useful in the context of automatic, open-bolt machine guns. It is also possible to further use the inventions disclosed herein in connection with closed-bolt, semi-automatic guns, e.g., with certain modifications consistent with semi-automatic guns. Additional features, uses, and advantages of the present inventions, with or without possible modifications are disclosed in: (A) U.S. Provisional Patent Application No. 62/163,019, filed May 18, 2015, entitled "REDUCED LENGTH BELT-FED FIREARM;" (B) the article entitled "MGA SAW K", Small Arms Defense Journal, Pages 104-107, Volume 8, Number 1 (published 2016); and (C) U.S. patent application Ser. No. 14/585,969 filed Dec. 30, 2014 entitled "Integrated Slide-Carrier and Firing Block Assembly," each of which is incorporated herein by reference.

What is claimed:

1. A firearm, comprising:

a receiver at least partially supporting a barrel assembly and a gas cycling assembly;

the barrel assembly comprising an elongated barrel having a forward end and a rear end, wherein the barrel includes a central bore extending from the forward end to the rear end, a chamber at the rear end, wherein the chamber defines a breach, and a gas port disposed in a side of the central bore providing fluid communication with the gas cycling assembly, wherein the gas port has a width of between about 0.063 inches and 0.200 inches and wherein a distance between a center of the gas port and the breach is between about 7.605 inches and about 9.395 inches; and the gas cycling assembly comprising a gas cylinder and an operating rod contained at least partially within the gas cylinder and configured to move longitudinally within the gas cylinder.

2. The firearm of claim 1, wherein the distance between a center of the gas port and the breach is between about 8.105 inches and about 8.645 inches.

3. The firearm of claim 1, wherein the length of the receiver is about 17.75 inches to about 20.3 inches.

4. The firearm of claim 1, wherein the length of the receiver is about 18.05 inches to about 19 inches.

5. The firearm of claim 1, wherein the firearm is a belt-fed machine gun.

6. The firearm of claim 1, wherein the gas port has a width of between about 0.063 inches and 0.092 inches.

7. The firearm of claim 1, wherein the gas port has a width of between about 0.080 inches and about 0.090 inches.

8. The firearm of claim 1, wherein the distance between a center of the gas port and the breach is between about 8.355 inches and about 8.395 inches and wherein the gas port has a width of between about 0.088 inches and about 0.090 inches.

9. The firearm of claim 1, wherein a kinetic energy dampener is located within the gas cycling assembly and in line with the operating rod and configured to dampen the rearward travel of the operating rod within the gas cylinder.

10. The firearm of claim 9, wherein the dampener comprises a first portion comprised of a wear disc adjacent a second portion comprised of one or more elastomeric polymer discs, wherein the thickness ratio between the first portion and the second portion is between about 1 to 3 and about 1 to 15.

11. The firearm of claim 9, wherein the dampener comprises a first portion and a second portion, wherein the first portion has a first thickness, and the second portion has a second thickness, the first portion comprising a first polymer disc, and the second portion comprising one or more additional polymer discs, and wherein the ratio between the first thickness and the second thickness is about 1 to 7.

12. The firearm of claim 11, wherein the first portion has a thickness of about 0.125 inches and the second portion has a thickness of about 0.875 inches.

13. The firearm of claim 12, wherein the first portion has a durometer rating of at least about 50A to about 75A and the second portion has a durometer rating of between about 5A and about 30A.

14. The firearm of claim 9, wherein the dampener comprises a first portion and a second portion, wherein the first portion has a first thickness, and the second portion has a second thickness, the first portion comprising a first polymer disc, and the second portion comprising one or more additional polymer discs, and wherein the ratio between the first thickness and the second thickness is between about 1 to 3 and about 1 to 15.

15. The firearm of claim 1, wherein a mounting bushing is coupled to the gas cylinder and selectively couples to a support configured to support the gun.

16. The firearm of claim 1, wherein the barrel assembly is configured for use with 5.56×45 mm ammunition cartridges.

17. The firearm of claim 1, wherein the barrel assembly is configured for use with 7.62×51 mm ammunition cartridges.

18. The firearm of claim 1, wherein the barrel assembly is configured for use with 6.8 mm SPC ammunition cartridges.

19. The firearm of claim 1, wherein the distance between the center of the gas port of the barrel and a gauge line in the chamber is between about 6.887 inches and about 6.927 inches.

20. The firearm of claim 1, wherein the barrel further includes a barrel extension with a front end connected to the barrel, and a rear end, wherein the distance between the center of the gas port of the barrel and the rear end of the barrel extension is between about 8.50 inches and about 9.75 inches.

21. The firearm of claim 1, wherein the rear end of the receiver includes a continuous termination plate.

22. The firearm of claim 21, wherein the rear end of the receiver includes a continuous termination plate such that the gas piston dampener is mounted against the termination plate and contained entirely within the receiver.

23. The firearm of claim 21, wherein a foldable buttstock is mounted to the continuous termination plate at the rear end of the receiver.

24. A belt-fed machine gun, comprising:

a receiver, a barrel assembly, and a gas cycling assembly;

the receiver at least partially supporting the barrel assembly and gas cycling assembly;

the barrel assembly comprising:

an elongated barrel having a forward end and a rear end, wherein the barrel includes a central bore extending from the forward end to the rear end, a chamber at the rear end, wherein the chamber defines a breach, and a gas port disposed in a side of the central bore providing fluid communication with the gas cycling assembly, wherein the gas port has a width of between about 0.085 inches and about 0.135 inches and wherein a distance between a center of the gas port and the breach is between about 8.105 inches and about 8.645 inches; and the gas cycling assembly comprising:

a gas cylinder;

an operating rod contained within the gas cylinder, and configured to travel rearward with a kinetic energy within the gas cylinder; and a kinetic energy dampener located longitudinally rearward of the operating rod, wherein the dampener is configured to dissipate the kinetic energy of the operating rod when struck by the operating rod.

25. The machine gun of claim 24, wherein the dampener is a polymer dampener is housed entirely within the receiver.

26. The machine gun of claim 24, wherein the dampener is a polymer dampener comprised of a plurality of discs of varying durometer ratings.

27. A belt-fed machine gun, comprising:

a receiver, a barrel assembly, and a gas cycling assembly;

the receiver at least partially supporting the barrel assembly and gas cycling assembly, the receiver having a length between about 18.05 inches and about 19 inches;

the barrel assembly further comprising:

an elongated barrel having a forward end and a rear end, wherein the barrel includes a central bore extending from the forward end to the rear end, a chamber at the rear end, wherein the chamber defines a breach, and a gas port disposed in a side of the central bore providing fluid communication with the gas cycling assembly, wherein the gas port has a width of between about 0.075 inches and 0.091 inches and a distance between a center of the gas port and the breach is between about 8.355 inches and about 8.395 inches; and the gas cycling assembly comprising:

a gas cylinder;

an operating rod contained at least partially within the gas cylinder and configured to move longitudinally within the gas cylinder;

a polymer kinetic energy dampener housed entirely within the receiver and in line with the operating rod, wherein the polymer kinetic energy dampener comprises a first portion comprised of a wear disc adjacent a second portion comprised of one or more elastomeric polymer discs, wherein the thickness ratio between the first portion and the second portion is about 1 to 7; and a mounting bushing coupled to the gas cylinder, wherein the mounting bushing selectively couples to a support.

28. The machine gun of claim 27, wherein the mounting bushing is removably attached to the gas cylinder, such that the machine gun can be selectively mounted on a support by connecting the support to the mounting bushing and to one or more brackets on a body of the receiver adjacent a trigger assembly.

29. The machine gun of claim 27, wherein the mounting bushing is comprised of a sleeve connected transversely to a tubular member.

30. The machine gun of claim 27, wherein the distance between the center of the gas port and the end of the breach is about 8.375 inches, the receiver length is about 18.3 inches, the gas port has a width of 0.089 inches, and a distance between a center of a bracket of the bushing mounted on the gas cylinder and the center of a bracket on the receiver adjacent a trigger package is about 11.106 inches, such that the gun can be conveniently mounted on a tripod stand.

* * * * *